US005525125A

United States Patent [19]

Cole et al.

[11] Patent Number: 5,525,125

[45] Date of Patent: *Jun. 11, 1996

[54] PROCESS FOR FIXING DYES IN TEXTILE MATERIALS

[75] Inventors: Arthur H. Cole; Susan C. Glenn, both of Charlotte, N.C.; Grannis S. Johnson, New Hope, Pa.

[73] Assignee: Henkel Corporation, Plymouth Meeting, Pa.

[ * ] Notice: The term of this patent shall not extend beyond the expiration date of Pat. No. 5,464,452.

[21] Appl. No.: 437,261

[22] Filed: May 8, 1995

Related U.S. Application Data

[63] Continuation-in-part of Ser. No. 240,305, May 10, 1994, Pat. No. 5,464,452.

[51] Int. Cl.[6] ..... D06P 5/08

[52] U.S. Cl. ..... 8/555; 8/558; 8/924; 8/926; 8/929

[58] Field of Search ..... 8/555, 557, 558, 8/529, 531, 582, 587, 594, 924, 929, 926, 115.55, 115.63

[56] References Cited

U.S. PATENT DOCUMENTS 4,236,098 11/1980 Horak et al. ..... 313/371
4,937,123 6/1990 Chang et al. ..... 428/96
5,288,600 2/1994 Yamanouchi et al. ..... 430/522

FOREIGN PATENT DOCUMENTS 456390 11/1991 European Pat. Off. .

*Primary Examiner*—Margaret Einsmann
*Attorney, Agent, or Firm*—Ernest G. Szoke; Wayne C. Jaeschke; Real J. Grandmaison

[57] ABSTRACT

A process for fixing dyes impregnated in fine-dimensional synthetic textile substrates in an environmentally safe manner. The process comprises contacting the dyed synthetic substrates with an aqueous solution of a phenol- and formaldehyde-free dye-fixative composition containing a copolymer of a) 1.0 to about 20 percent by weight of vinyl sulfonic acid residues;

b) 5 to 20 percent by weight of nonpolar or hydrophobic monomer residues; and c) 60 to about 94 percent by weight of hydrophilic ethylenically unsaturated carboxylic acid residues, the copolymers having a weight average molecular weight of from about 1,500 to about 15,000. The contacting step is for a time sufficient so that the dye-fixative composition is absorbed by the fabric.

6 Claims, No Drawings

PROCESS FOR FIXING DYES IN TEXTILE MATERIALS

This application is a continuation-in-part application of pending application U.S. Ser. No. 08/240,305 filed on May 10, 1994 now U.S. Pat. No. 5,464,452.

FIELD OF THE INVENTION

The present invention generally relates to a process for treating dyed textile materials. More particularly, dyed knit and woven apparel fabric made of polyamide-containing substrates, segmented polyester-polyurethane substrates, or combinations thereof, are treated with a synthetic dye fixative composition containing a methacrylic acid component to fix the dye in the fabric in order to improve its wash fastness and color fastness, thus precluding the dye's outward migration and color change.

BACKGROUND OF THE INVENTION

Dyes are intensely colored substances used for the coloration of various substrates, including paper, leather, fur, hair, foods, drugs, cosmetics, plastics, and textile materials. They are retained in these substrates by physical adsorption, salt or metal-complex formation, solution, mechanical retention, or by the formation of covalent bonds. The methods used for the application of dyes to the substrates differ widely, depending upon the substrate and class of dye. It is by application methods, rather than by chemical constitutions, that dyes are differentiated from pigments. During the application process, dyes lose their crystal structures by dissolution or vaporization. The crystal structures may in some cases be regained during a later stage of the dyeing process. Pigments, on the other hand, retain their crystal or particulate form throughout the entire application procedure. They are usually applied in vehicles, such as paint or lacquer films, although in some cases the substrate itself may act as the vehicle, as in the mass coloration of polymeric materials.

The principal usage or application classes of dyes accounting for 85% of production in the United States are as follows: acid dyes, basic dyes, direct dyes, disperse dyes, fluorescent brighteners, reactive dyes, sulfur dyes, and vat dyes.

Dyeing describes the imprintation of a new and often permanent color, especially by impregnating with a dye, and is generally used in connection with textiles, paper, and leather. Printing may be considered as a special dyeing process by which the dye is applied in locally defined areas in the form of a thickened solution and then fixed.

Generally, dyes are dissolved or dispersed in a liquid medium before being applied to a substrate where they are fixed by chemical or physical means, or both. Owing to its suitability, its availability, and its economy, water usually is the medium used in dye application; however, nonaqueous solvents have been studied extensively in recent years.

Textile substrates can be classified in three groups: cellulosic, protein, and synthetic polymer fibers. Economical and uniform distribution of a small amount of dye throughout the substrate and fixation of the dye are the keys to dyeing, i.e., with regard to fastness to washing and to other deteriorating influences. It is the fixation of the dye to a substrate to which the present invention is directed.

The production of dyeings of acceptable quality requires the use of many auxiliary products and chemicals. These include chemicals that improve fastness properties such as bleaching agents, wetting and penetrating agents, leveling and retarding agents, and lubricating agents. Other agents are used to speed the dyeing process or for dispersion, oxidation, reduction, or removal of dyes from poorly dyed textiles.

Dyes of similar or identical chromophoric class are used for widely differing applications and, therefore, are classified according to their usage rather than their chemical constitution. Dyes with identical or similar solubilizing groups generally display similar dyeing behavior even though their main structure may vary substantially. Another important consideration in the use of a given dye for a specific application and fastness properties of commercial dyes is found in the pattern cards issued by their manufacturers. The following classification of colorants for dyeing is used: acid, basic, direct, disperse, insoluble azo, sulfur, vat, fiber-reactive, miscellaneous dyes, and pigments.

The most common types of fibers to be dyed with acid dyes are polyamide, wool, silk, modified acrylic, and polypropylene fibers, segmented polyester-polyurethane, as well as blends of the aforementioned fibers with other fibers such as cotton, rayon, polyester, regular acrylic, etc. Approximately 80–85% of all acid dyes sold to the U.S. textile industry are used for dyeing nylon, 10–15% for wool, and the balance for those fibers mentioned above. Acid dyes are organic sulfonic acids; the commercially available forms are usually their sodium salts, which exhibit good water solubility.

The two major polyamide types commercially available today are nylon 6, and nylon 6,6. Both fiber types are typically very receptive to acid dyes under certain conditions. A direct relationship exists between the chemical structure of an acid dye and its dyeing and wetfastness properties. The dyeing process is influenced by a number of parameters, such as: dyestuff selection, type and quantity of auxiliaries, pH, temperature and time.

Affinity and diffusion are fundamental aspects of the dyeing process. The former describes the force by which the dye is attracted by the fiber, and the latter describes the speed with which it travels within the fiber from areas of higher concentration to areas of lower concentration.

In the application of dyes, there have developed over the years three chief principles of dyeing textiles. In one case, the dye liquor is moved as the material is held stationary. In another case, the textile material is moved without mechanical movement of the liquor. Examples of the foregoing include jig dyeing and continuous dyeing which involves the padding of the fabric. A combination of the two is exemplified by a Klauder-Weldon skein-dye machine in which the dye liquor is pumped as the skeins are mechanically turned. Another example is a jet or spray dyeing machine in which both the goods and the liquor are constantly moving.

A substantially non-mechanical dyeing process is typically referred to as exhaustion. This process involves the preparation of a dye bath containing an aqueous solution, usually water, and the dye. The textile to be dyed is then inserted into the dye bath. The temperature of the dye bath is then raised to a predetermined optimal level, with the pH of the bath being similarly maintained, and the textile material is then soaked in the bath. During this soaking process, the dye contained in the bath is absorbed into the fibers of the textile material in accordance with the principles of affinity and diffusion as described above. Once all of the dye has been absorbed, the bath is referred to as being exhausted, with only the aqueous solution being left.

The selection of proper dyeing equipment depends on the nature and volume of the material to be dyed. Raw stock and yarns are dyed by exhaust methods, whereas fabrics are dyed both by exhaust or continuous methods. The choice of method for fabrics depends largely on the volume to be dyed. Continuous dyeing is usually employed where the volume of fabric for a particular shade is about 10,000 yards or more.

In the dyeing of fabrics, the beck is one of the oldest dyeing machines known. It consists of a tub containing the dye liquor, and an elliptical winch or reel which is located horizontally above the dye bath. Ten or more pieces of fabric are dyed simultaneously. Each piece is drawn over the winch, and its two ends are sewn together to form an endless rope. The ropes are kept in the dyeing machine side by side, separated from each other by rods to prevent them from tangling. During the dyeing process the reel rotates, pulling the ropes out of the dye bath and dropping them back into the dye bath at the opposite side. In this way almost all the fabric is kept inside the dye bath.

Becks are used for dyeing knits and other light-weight fabrics that can be easily folded into a rope form without causing damage. Fabrics made of filament yarns that tend to break should not be dyed in a beck since the broken filaments will dye deeper. Very light fabrics should also be avoided as they may tend to float on the dye bath and tangle.

Jet dyeing machines are similar to becks in that the fabric is circulated through the dye bath in the rope form. However, in a jet the transportation of the fabric occurs by circulating the dye liquor through a venturi jet, instead of the mechanical pull of the reel in a beck. The fabric is pulled out of the main dyeing chamber by means of a high speed flow of dye liquor that passes through the venturi opening.

Modern jet dyeing machines are generally categorized as "round kier" or "cigar kier" configurations. Most fabrics can be dyed satisfactorily in conventional round kier dyeing machines such as the Gaston 824 jet dyeing machine. These types of machines operate at low liquor ratio and yield very good results on most fabrics. However, certain fabrics have more of a tendency to develop crush or pile marks due to their constructions.

Padders are used to impregnate fabrics with liquors containing dyes, dyeing assistants or other chemicals. Padding is usually followed continuously by other treatments, from drying to a series of successive treatments. The simplest padder consists of two parts: the trough containing the dye liquor, and two squeezing rollers arranged above the dye liquor. In the padding process, the fabric in its open width form, enters the trough through tension rails, passes through the dye liquor, and is then squeezed between two heavy rubber rollers with the proper hardness, under pressure. Excess dye liquor runs back into the trough.

Impregnation is typically followed by drying during which dye migration becomes a major concern. Evaporating water tends to carry with it dye particles from wet spots to dry spots on the fabric, and from the inside or back to the face of the fabric, and may lead to uneven and/or shading problems. To prevent migration, drying is done gradually, and/or a chemical migration inhibiting agent may be used to treat the dyed substrate.

Once the dyed substrate is sufficiently dried, the dye must then be fixed to the substrate so to preclude its bleeding from the substrate. One method of achieving this is through the use of a fixation oven. These ovens are used when fixation of the dyes is performed with dry heat. Both hot flue or heated cans are used for this purpose. Since temperatures as high as 215° C. are often required, the cans are heated with hot oil or gas. Contact heating, as with heated cans, has the advantage that less time is required for the fixation process as compared to the use of dry air.

Another method of fixing dyes to a substrate is by treating the substrate with a dye fixative which similarly improves the wetfastness of a dyed textile by precluding the dye from bleeding or migrating out of the textile material after it comes in contact with water. For example, it is desirable that an article of dyed clothing retain its color while it is being washed using various laundry detergents, whether in a washing machine or by hand. Similarly, when rain water and the like comes in contact with a dyed article of clothing, the retention of the dye within the fibers of the material, rather than its migration onto other substrates is highly desirable. It is to these types of aftertreatments for these particular purposes to which the present invention is directed.

The reason that a dye fixative may be necessary is dependent on the type of acid dye being employed. For example, those acid dyes that offer excellent dyeing characteristics such as good leveling, migration, and coverage of barre, have only marginal wetfastness properties. Conversely, those acid dyes that provide high wetfastness do not level very well. Obviously, the employment of the first type of acid dyes requires the use of a fixing additive to improve the relatively poor wetfastness properties of those dyes. However, it is oftentimes also desirable to further enhance the wetfastness properties of dyes already adequate in their wetfastness ability.

A number of fixing agents or dye fixatives currently being used in the industry contain formaldehyde and phenols. The environmental disadvantages associated with their use are well known. However, another serious disadvantage associated with their use in combination with dyed materials is their tendency to discolor the dyed material due to a chemical reaction between the phenols and the dye. Consequently, this results in a substantial financial loss of product and resources.

Therefore, there is a need to provide a process for fixing dyes absorbed in synthetic textile materials which is more environmentally friendly than the currently used fixatives containing phenols and formaldehyde, while at the same time significantly decreasing the occurrence of discoloration of dyed synthetic substrates upon application of the dye fixative in order to improve the wetfastness and colorfastness of the dyed finished products.

The present invention provides a process for the fixing of dyes contained in synthetic textile materials in just such a manner.

SUMMARY OF THE INVENTION

Other than in the operating examples, or where otherwise indicated, all numbers expressing quantities of ingredients or reaction conditions used herein are to be understood as modified in all instances by the term "about".

The present invention provides a process for fixing dyes impregnated in knit and woven apparel fabric made from the group consisting of polyamide-containing substrates, segmented polyester-polyurethane substrates, and combinations thereof, by contacting the substrate with a dye-fixative composition substantially free of phenols and/or formaldehydes. Dye-fixative compositions typically used in the industry contain residual phenols and/or formaldehyde. The environmental hazards associated with such toxic substances are commonly known. However, these substances also cause the discoloration or, more particularly, shade variation of the dye with which they come into contact. For example, Rhodamine® dyestuffs, treated with a dye-fixative containing one or both of such compounds has a tendency to experience a variation in shade which ultimately results in the substrate either being damaged or necessitating further dyeing to replace the lost dyes. This phenomenon is caused by a chemical reaction between the dye and the phenols present in the dye-fixative.

It has now been surprisingly found that by contacting dyed knit and woven apparel fabric made from the group consisting of a polyamide-containing substrate, a segmented polyester-polyurethane substrate, and combinations thereof, with a dye-fixative composition based on methacrylic acid, free of phenols and/or formaldehyde, a more effective and less environmentally harmful method of fixing dyes can be achieved.

The present invention provides a process for fixing dyes to knit and woven apparel fabric made from the group consisting of polyamide-containing substrates, segmented polyester-polyurethane substrates, and combinations thereof, comprising contacting said substrates with an aqueous dye-fixative composition substantially free of phenols and/or formaldehyde, said dye-fixative composition comprising:

(a) polymethacrylic acid, (b) copolymers of methacrylic acid consisting essentially of methacrylic acid and an ethylenically unsaturated comonomer selected from the group consisting of 2-acrylamido-2-methyl-propanesulfonic acid, sodium vinyl sulfonate, sodium styrene sulfonate, lower alkyl acrylates, and mixtures thereof, (c) combinations of (a) and (b), and (d) water.

Preferably, the dye-fixative application comprises: (a) from about 2.0 to about 8.0% by weight of polymethacrylic acid, and/or (b) copolymers of methacrylic acid, and (c) from about 92.0 to about 98.0% by weight water.

Various methods can be employed to apply the dye-fixative composition onto the polyamide-containing substrate, segmented polyester-polyurethane substrate, or combinations thereof. For example, the dye-fixative composition can be applied by means of a process known as exhaustion. In exhaust dyeing, the contact between the substrate and the dye liquor is achieved by one of the following ways: (1) dye liquor is circulated continuously by a pump through the substrate that remains stationary, or (2) the substrate is circulated through the stationary dye liquor, or (3) both are in continuous movement, i.e., while the dye liquor is circulated, the substrate is in constant movement. Regardless of the particular exhaust method employed, the dye-fixative is placed in an aqueous bath, after which the temperature of the bath is raised and maintained at an optimal level. The polyamide-containing substrate, segmented polyester-polyurethane substrate, or combination thereof is then placed in the dye-fixative bath and soaked for a predetermined amount of time. While the substrate soaks in the bath, the dye-fixative becomes absorbed by the fibers of the substrate. Other application processes which may be employed include, but are not limited to, padding or continuous dyeing, and spraying.

DETAILED DESCRIPTION OF THE INVENTION

The manufacture of apparel fabric made from polyamide-containing substrates such as Nylon® 6 and Nylon 6,6, as well as with segmented polyester-polyurethane containing substrates such as Lycra® and Spandex®, and combinations thereof, is typically accomplished pursuant to two textile manufacturing methods, knitting and weaving.

With respect to the knitting process, there are two specific methods, warp knitting and circular knitting. In general, however, knitting is a method of constructing fabric by interlocking a series of loops of one or more yarns. Warp knitting involves combining yarns which run lengthwise in the fabric. The yarns are prepared as warps on beams with one more yarn for each needle. Examples of this type of knitting include tricot and raschel knits. Circular knitting is a more common type of knitting in which one continuous yarn runs crosswise in the fabric making all of the loops in course. The fabric is in the form of a tube.

Weaving is the process of interlacing two yarns of similar materials so that they cross each other at right angles to produce a woven fabric.

In contrast to the foregoing knitted or woven apparel fabrics, a tufted carpet is produced on a tufting machine which is essentially a multi-needle sewing machine which pushes the pile yarns through a primary backing fabric and holds them in place to form loops as the needles are withdrawn from the backing fabric.

In general, apparel fabric is knit or woven from fine dimension yarns, in contrast to carpet which is produced from large dimension yarns. It is thus desirable to fix dyes impregnated in knit and woven apparel fabric made from polyamide-containing substrates or segmented polyester-polyurethane substrates or combinations thereof in order to prevent or reduce the likelihood of their bleeding and/or fading out when exposed to water, chemical laundering detergents, and sunlight in as ecologically safe a manner as possible. Dye-fixatives typically used in the industry oftentimes contain phenols and formaldehyde. These substances form residues upon degradation which, when released into the environment, are detrimental thereto. It has now been found that by employing a process wherein a dyed polyamide-containing substrate or segmented polyester-polyurethane substrate or combination thereof is contacted with a dye-fixative composition based on methacrylic acid, the dye is effectively fixed to the fibers of the substrate so that little if any of the dye bleeds from the substrate upon contact with water. The tendency of a dye to bleed and/or fade out of a substrate upon contact with water or detergents relates to the wash-fastness, or more generally "color-fastness" of the substrate. More particularly, color-fastness means the resistance of a material to change in any of its color characteristics, to transfer of its colorant(s) to adjacent materials, or both, as a result of exposure of the material to any environment that might be encountered during the processing, testing, storage or use of the material.

According to the invention, dyes are fixed to knit and woven apparel fabric made from polyamide-containing substrates or segmented polyesterpolyurethane substrates or combinations thereof by contacting the fabric with an aqueous dye- fixative solution comprising polymethacrylic acid, copolymers of methacrylic acid, or combinations thereof present in a sufficient amount and having a solubility and molecular weight such that the fabric has improved dye fixation with respect to its color-fastness upon exposure to water and various laundry detergent products.

More particularly, dyes are fixed to a polyamide-containing substrate or segmented polyester-polyurethane substrate or combinations thereof by contacting the dyed substrate with a dye-fixative composition comprising;

(a) polymethacrylic acid, (b) copolymers of methacrylic acid consisting essentially of methacrylic acid and an ethylenically unsaturated comonomer selected from the group consisting of 2-acrylamido-2-methyl-propanesulfonic acid, sodium vinyl sulfonate, sodium styrene sulfonate, lower alkyl acrylates, and mixtures thereof, (c) combinations of (a) and (b), and (d) water.

A preferred dye-fixative composition for a dyed substrate in accordance with this invention comprises a) 1.0 to about 20 percent by weight of vinyl sulfonic acid residues;

b) 5 to 20 percent by weight of nonpolar or hydrophobic monomer residues; and c) 60 to about 94 percent by weight of hydrophilic ethylenically unsaturated carboxylic acid residues, the copolymers having a weight average molecular weight of from about 1,500 to about 15,000.

Preferably the copolymer comprises:

a) 1.5 to about 10 percent by weight of vinyl sulfonic acid residues;

b) 5 to about 20 percent by weight of residues of at least one composition selected from the group consisting of amides of (meth)acrylic acid with $C_4$ to $C_{10}$ amines, esters of (meth)acrylic acid with $C_2$ to $C_8$ alcohols, amides of $\alpha$-$C_2$ to $C_4$ alkyl acrylic acid with $C_4$ to $C_{10}$ amines and esters of $\alpha C_2$ to $C_4$ alkyl acrylic acid with $C_2$ to $C_8$ alcohols; and c) about 70 to about 93.5 percent by weight of residues of at least one acid selected from the group consisting of (meth)acrylic acid, maleic anhydride or its equivalent maleic acid, itaconic acid, fumaric acid and $\alpha$-$C_2$ to $C_4$ alkyl acrylic acid wherein the weight average molecular weight is from about 2,500 to about 10,000.

More preferably the copolymer comprises:

a) 1.5 to 8 percent by weight of vinyl sulfonic acid residues;

b) 5 to about 20 percent by weight of residues of at least one ester of (meth)acrylic acid with at least one $C_3$ to $C_6$ aliphatic alcohol; and c) about 72 to about 93.5 percent by weight of residues of (meth)acrylic acid, wherein the weight average molecular weight is from about 2,500 to about 10,000.

Most preferably the copolymer comprises:

a) 1.5 to 6 percent by weight of vinyl sulfonic acid residues;

b) 5 to 20 percent by weight of at least one ester of acrylic acid with a $C_3$ to $C_6$ aliphatic alcohol; and c) about 74 to about 93.5 percent by weight of methacrylic acid residues wherein the copolymer has a weight average molecular weight of from about 3,000 to about 9,000.

The afore-mentioned copolymers comprise relatively small amounts of vinyl sulfonic acid residues ($CH_2{=}CH{-}SO_3H$) or salts thereof. The vinyl sulfonic acid residues are present in the copolymer at from about 1.0 to about 20 percent by weight of the copolymer, preferably from 1.5 to about 10 percent by weight, more preferably from 1.5 to about 8 percent by weight of the copolymer, still more preferably from about 1.5 to less than 6 and more preferably less then 5 percent by weight of the copolymer and most preferably from about 2 to about 4 percent by weight of the copolymer. The presence of vinyl sulfonic acid residues in the copolymer provide for application of the copolymer at a lower pH than the pH at which a copolymer having only carboxylic acid groups can be used as a dye-fixative composition.

The copolymer of the present invention contains small amounts, in the range of 5 to about 20 percent, preferably 5 to 15 percent, and most preferably 8 to 14 percent by weight of nonpolar or hydrophobic monomer residues. The nonpolar or hydrophobic monomer residues can be amides of (meth)acrylic acid with $C_4$ to $C_{10}$ amines, esters of (meth-)acrylic acid with $C_2$ to $C_8$ alcohols, amides of $\alpha$-$C_2$ to $C_4$ alkyl acrylic acid with $C_4$ to $C_{10}$ amines, and esters of $\alpha$-$C_2$ to $C_4$ alkyl acrylic acid with $C_2$ to $C_8$ alcohols. Preferably the amides contain from 4 to 8 carbon atoms in the amide group and the esters are esters of aliphatic alcohols having from 3 to 5 carbon atoms. The hydrophobic residues are preferably residues of amides or esters of (meth)acrylic acid and more preferably esters of acrylic acid. As used herein, (meth)acrylic refers to acrylic acid, methacrylic acid or mixtures thereof.

The composition of the present invention can include hydrophobic moieties which are the residues of ethylenically unsaturated essentially hydrocarbon moieties containing from about 4 to about 10 carbon atoms. Hydrocarbons such as butene, amylene, hexene, heptene, octene, styrene, $\alpha$-methyl styrene, pentene, dipentene, vinyl naphthalene, and the like can be useful to provide the hydrophobic residues in the copolymer of the invention.

The copolymer of the invention contains hydrophilic moieties which are the residues of ethylenically unsaturated carboxylic acids or their anhydrides. Ethylenically unsaturated carboxylic acid such as (meth)acrylic acid, maleic anhydride or its equivalent maleic acid, $\alpha$-$C_2$ to $C_4$ alkyl acrylic acid, fumaric acid, itaconic acid and the like can be useful in the copolymers of the invention.

Preferred hydrophilic moieties are the residues of acrylic acid, maleic acid, and methacrylic acid. The hydrophilic carboxylic acid residues are present at from about 60 to about 94 percent by weight of the copolymer, preferably from about 70 to about 94 percent by weight of the copolymer and most preferably from about 74 to about 93.5 percent by weight of the copolymer. The hydrophilic moieties enhance the solubility of the copolymer in water to provide for ease of penetration of the textile. The copolymer is generally partially neutralized to provide a copolymer which is soluble in water. The presence of the vinyl sulfonic acid residues enables the copolymer to become soluble at a lower pH which aids in treating dyed textiles.

The copolymers of the invention have a weight average molecular weight of from about 1,500 to about 15,000 and preferably from about 2,500 to about 10,000 and most preferably from 3,000 to about 9,000. The low molecular weight and water solubility of the polymer provides a copolymer which is readily soluble in water and can easily penetrate texiles. The combination of properties of the copolymer provides a material which is useful for treating textiles and particularly for fixing a dye thereto.

The copolymers of the present invention are prepared by free radical polymerization. The copolymers can be prepared in bulk, in a solvent or in water. It is preferred to prepare the copolymer in a solvent or a mixture of a solvent and water. The preferred solvents are lower alcohols such as methyl, ethyl, propyl, isopropyl, butyl and isobutyl alcohols. The low boiling point solvents are particularly useful since the solvent is removed after the polymerization and the copolymer prepared as a solution or dispersion in water. During the polymerization a small amount of an alkaline material such as sodium hydroxide or ammonia is introduced into the polymerization zone. At the end of the polymerization, the solvent is removed and some additional alkaline material added to solubilize or disperse the copolymer in water. The concentration is adjusted to the range at which the copolymer is sold or to which it is diluted for use. Generally a 15 to about 60 percent by weight solution or dispersion of the copolymer is prepared. The solution is diluted to a 1 to about 30 percent (active) solution or dispersion in water for use in fixing a dye to a textile substrate.

The copolymer can be prepared by heating a 1:1 by weight mixture of deionized water and isopropanol under nitrogen to a temperature of about 80° C. A solution of a water soluble free radical initiator such as sodium persulfate is prepared. A mixture of the monomers to be polymerized, ammonia and water is prepared. The solution of the initiator and the mixture of the monomers, water and ammonia are concurrently introduced into the water and alcohol mixture maintained at a temperature of 80° C. over a period of several hours. After the addition of the monomers has been completed the polymerization mixture is maintained at 80° C. for about an hour. The temperature is then slowly raised to about 100° C. and an alcohol water mixture is distilled from the polymer. When the temperature reaches 100° C., the distillation is stopped and water and additional ammonia are added to the mixture until the mixture becomes clear and the desired copolymer concentration has been obtained. The concentration of the copolymer solution or dispersion is generally in the range of about 30 to about 60 percent by weight. The volatile organic solvent is reduced in the composition to less than about 5 percent and most preferably to less than about 3 percent by weight of the mixture. Vacuum distillation can also be used to remove volatile organic compounds from the dispersion and/or solution of the copolymer. The copolymers are useful for fixing a dye to a dyed textile substrate.

The polymethacrylic acid, copolymers of methacrylic acid, or combinations thereof useful in the present invention are preferably hydrophilic. As used herein, the term "methacrylic polymer", is intended to include the polymethacrylic acid homopolymer as well as polymers formed from methacrylic acid and one or more other monomers. The monomers useful for copolymerization with the methacrylic acid are monomers having ethylenic unsaturation. Such monomers include, for example, monocarboxylic acids, polycarboxylic acids, and anhydrides; substituted and unsubstituted esters and amides of carboxylic acids and anhydrides; nitriles; vinyl monomers; vinylidene monomers; monoolefinic and polyolefinic monomers; and heterocyclic monomers. Particularly preferred comonomers include alkyl acrylates having 1–4 carbon atoms, such as butyl acrylate, 2-acrylamido-2-methyl-propanesulfonic acid, sodium vinyl sulfonate, and sodium styrene sulfonate.

Representative monomers include, for example, acrylic acid, itaconic acid, citraconic acid, aconitic acid, maleic acid, maleic anhydride, fumaric acid, crotonic acid, cinnamic acid, oleic acid, vinyl sulfonic acid, vinyl phosphonic acid, alkyl or cycloalkyl esters of the foregoing acids, the alkyl or cycloalkyl groups having 1 to 18 carbon atoms such as, for example, ethyl, butyl, 2-ethylhexyl, octadecyl, 2-sulfoethyl, acetoxyethyl, cyanoethyl, hydroxyethyl and hydroxypropyl acrylates and methacrylates, and amides of the foregoing acids, such as for example, acrylamide, methacrylamide, methylolacrylamide, and 1,1-dimethylsulfoethylacrylamide, acrylonitrile, methacrylonitrile, styrene, α-methylstyrene, p-hydroxystyrene, chlorostyrene, sulfostyrene, vinyl alcohol, N-vinyl pyrrolidone, vinyl acetate, vinyl chloride, vinyl ethers, vinyl sulfides, vinyl toluene, butadiene, isoprene, chloroprene, ethylene, isobutylene, vinylidene chloride, sulfated castor oil, sulfated sperm oil, sulfated soybean oil and sulfonated dehydrated castor oil.

Preferably, the methacrylic acid comprises about 30 to 100 weight percent, more preferably about 60 to about 90 weight percent, of the methacrylic polymer. The optimum proportion of methacrylic acid in the polymer is dependent on the comonomer used, the molecular weight of the polymer, and the pH at which the material is applied. When water-insoluble comonomers, such as ethyl acrylate are copolymerized with the methacrylic acid, they may comprise up to about 40 weight percent of the methacrylic polymers. When water-soluble monomers, such as acrylic acid or sulfoethyl acrylate are copolymerized with the methacrylic acid, the water-soluble comonomers preferably comprise no more than about 30 weight percent of the methacrylic polymer, and preferably the methacrylic polymer also comprises up to about 50 weight percent water-insoluble monomer.

The weight average molecular weight and the number average molecular weight of the methacrylic polymer should be such that satisfactory dye-fixation is provided by the polymer. Generally, the lower 90 weight percent of the polymer material preferably has a weight average molecular weight in the range of about 2000 to 250,000, more preferably in the range of about 3000 to 100,000. Generally, the lower 90 weight percent of the polymer material preferably has a number average molecular weight in the range of about 500 to 20,000, more preferably in the range of about 800 to 10,000. Generally, more water-soluble comonomers are preferred when the molecular weight of the polymer is high and less water-soluble or water-insoluble comonomers are preferred when the molecular weight of the polymer is low.

The amount of methacrylic polymer used should be sufficient to effectively fix the dye to the substrate. The types of substrates which will be treated with the dye- fixative composition will vary, but will include articles of apparel made of a polyamide substrate, segmented polyester-polyurethane substrate, and combinations thereof. For example, polyamide substrates such as Nylon 6 or 6.6, or segmented polyester-polyurethane substrates such as Lycra which may be used for making swimsuits or aerobics apparel and other forms of apparel, can be treated with the dye-fixative composition of the present invention in order to improve their wetfastness and colorfastness. Preferably, the amount of methacrylic polymer present in the dye-fixative composition is at least about 50 weight percent based on the weight of the composition. Most preferably, the amount of methacrylic polymer is at least about 75 weight percent, based on the weight of the dye-fixative composition when the polyamide substrate is Nylon 6. When the substrate is Nylon 6,6, the amount of methacrylic polymer is at least about 50 weight percent, and most preferably at least about 75 weight percent, based on the weight of the dye-fixative composition.

Generally, the dye-fixative composition is applied to the fabric from an aqueous bath per the exhaust method. The pH of the bath is preferably between about 4.0 and about 5.0, and most preferably about 4.3 to 4.7. The temperature of the aqueous bath is preferably between about 140° F. and about 180° F., and most preferably about 155° F. to 165° F. It should be noted, however, that the pH and temperature ranges are dependent on many variables including both the type of fabric substrate being treated and the type of dyestuff being fixed.

Alternatively, the dye-fixative composition can be applied by a method similar to that of a continuous dyeing operation. According to this method, the fabric substrate travels along rollers into and out of an aqueous bath, similar to the dyeing process. However, rather than dye being applied onto the substrate, the dye-fixative composition is applied.

Another method of applying the dye-fixative composition is known as a padding operation, whereby the dye-fixative is padded or blotted onto the substrate. This operation is very similar to that of the continuous dyeing operation since the substrate is mechanically carried into and out of the padding apparatus.

The dye-fixative composition can also be applied onto the substrate by other methods well known in the art such as by jet spraying. Spray applicators such as those available from Otting International can be employed to spray the dye-fixative onto the substrate. It should be noted, however, that the substrate can be treated with the dye-fixative in any known manner without departing from the spirit of the invention, so long as contacting the fabric substrate with the disclosed dye-fixative composition is performed.

The dye-fixative composition can also be used in conjunction with other conventional finishing agents/additives such as softeners, leveling agents and the like. These can be added to the bath together with the dye-fixative composition.

In the present invention, preferably dyed textile substrates are contacted with the composition of the invention. The dyed textile is contacted with an aqueous solution or dispersion of the copolymer of the invention. The copolymer of the invention is added to the aqueous solution in an amount (active substance) to provide from about 1 to about 10 percent by weight of the copolymer of the textile being treated. The dyed textile is contacted for a sufficient length of time to evenly impregnate the textile with the copolymer and fix the dye.

The following non-limiting examples serve to illustrate the invention. In the following examples, all ratios are by weight and percentages are weight percentages unless otherwise indicated.

PREPARATION OF DYE-FIXATIVE COMPOSITIONS

EXAMPLE A

To a reaction vessel equipped with a reflux condenser, a mechanical stirrer, a thermometer, a gas inlet tube and two liquid inlet ports were charged 130 g. of isopropanol and 35 g. of deionized water. A nitrogen sparge was begun and the reactor contents were heated, while stirring, to about 80° C. At this temperature, a solution containing 146 g. (1.7 mole) of methacrylic acid, 17.6 g. (0.085 mole) of 2-acrylamido-2-methylpropane sulfonic acid and 45 g. of deionized water and another solution containing 18.2 g. (0.076 mole) of sodium persulfate initiator in 47.8 g. deionized water were pumped into the reactor containing the monomer mixture in about two hours. The reactor contents were heated at about 80° C. for about one hour longer. The resulting copolymer solution was cooled and transferred to a distilling flask which was equipped with a thermometer, a mechanical stirrer, and a distilling head which was connected to a condenser and receiver. The reactor was rinsed with 500 g. of deionized water which was combined with the polymer solution in the distilling flask. The resulting solution was then heated to the boil at atmospheric pressure, the resulting distillate of isopropanol and water being collected in the receiving flask. This process was continued until the distillation temperature reached 99°–100° C. to insure removal of essentially all of the isopropanol. There was obtained 682 g. of a 26.2% aqueous solution of a copolymer, in a 20 to 1 mole ratio, respectively, of methacrylic acid and 2-acrylamido-2-methylpropane sulfonic acid.

EXAMPLE B

The process of Example A was repeated using, as polymerization solvent, 130 g. of isopropanol and 35 g. of deionized water, a monomer solution of 129 g. (1.5 mole) of methacrylic acid, 20.7 g. (0.10 mole) of 2-acrylamido-2-methyl propane sulfonic acid and 45 g. of deionized water, and an initiator solution of 16.6 g. (0.07 mole) of sodium persulfate in 50 g. of deionized water. After removal of isopropanol by distillation and concentration adjustment with deionized water, there was obtained 800 g. of a 22.7% solution of a copolymer, in a 15 to 1 mole ratio, respectively of methacrylic acid and 2--acrylamido-2methylpropane sulfonic acid.

EXAMPLE C

The process of Example A was repeated using as polymerization solvent a mixture of 195 g. of isopropanol and 52.5 g. of deionized water, a monomer solution of 162 g. (1.88 mole) of methacrylic acid alone in 40 g. of deionized water, and an initiator solution of 20 g. (0.84 mole) of sodium persulfate in 40 g. of deionized water. There was obtained 749 g. of a 24% aqueous solution of polymethacrylic acid.

EXAMPLE D

The process of Example A was repeated using a mixture of 139 g. of isopropanol and 38 g. of deionized water as polymerization solvent, a monomer solution consisting of 129 g. (1.5 mole) of methacrylic acid and 52 g. (0.10 mole) of a 25% aqueous solution of sodium vinyl sulfonate in 420 ml. of 33% isopropanol in deionized water, and an initiator solution of 15 g. sodium persulfate (0.063 mole) in deionized water to make 50 ml. After polymerization, removal of solvent and a concentration adjustment with deionized water, there was obtained 496 g. of a 33.15% aqueous solution of a copolymer, in a 15 to 1 mole ratio, respectively, of methacrylic acid and sodium vinyl sulfonate.

EXAMPLE E

The process of Example B including identity and amounts of solvents, monomers, and initiator was followed, except the acid product was neutralized with 28% ammonium hydroxide. There was obtained a 23% aqueous solution of the ammonium salt of the methacrylic acid/2-acrylamido-2-methylpropane sulfonic acid copolymer described in Example B.

EXAMPLE F

The process of Example A was followed using a mixture of 130 g. of isopropanol and 35 g. of deionized water as polymerization solvent, a monomer solution consisting of 129 g. (1.5 mole) of methacrylic acid, 20.7 g. (0.10 mole) of sodium styrene sulfonate in 45 g. of deionized water, and an initiator solution of 16.0 g. (0.07 mole) of ammonium persulfate dissolved in deionized water to make 60 ml. There was obtained 427 g. of a 34.5% aqueous solution of a copolymer, in a 15 to 1 mole ratio, respectively, of methacrylic acid and sodium styrene sulfonate.

EXAMPLE G

The process of Example A was followed using the same composition of polymerization solvent, a monomer solution consisting of 110 g. (1.28 mole) of methacrylic acid, 19 g. (0.148 mole) of butyl acrylate, 20.7 g. (0.10 mole) of sodium styrene sulfonate, and 45 g. of deionized water, and an initiator solution consisting of 16.6 g. (0.07 mole) of sodium persulfate dissolved in water to give 60 ml. There was obtained, after removal of isopropanol and adjustment of solids content with deionized water, 676 g. of a 25% solution of a terpolymer, in the proportions described, of methacrylic acid, butyl acrylate and sodium styrene sulfonate.

EXAMPLE H

The process of Example A was followed using a polymerization solvent of 93 g. of isopropanol and 93 g. of deionized water, a monomer blend of 118.3 g. (1.38 mole) of methacrylic acid, 16.1 g. (0.126 mole) of butyl acrylate, and 61.2 g. (0.12 mole) of 25% aqueous solution of sodium vinyl sulfonate, and 23 g. of 28% ammonium hydroxide, and an initiator solution of 16.6 g. (0.07 mole) of sodium persulfate dissolved in deionized water to make 50 ml. After solvent removal by distillation and water adjustments, there was obtained 547 g. of a 31.7% aqueous solution of a terpolymer of methacrylic acid, butyl acrylate and sodium vinyl sulfonate in the proportions described.

EXAMPLE I

The process of Example C was followed except the polymerization solvent was changed from isopropanol/water to 285 g. of deionized water alone. After polymerization was completed, the resulting polymer solution was cooled down and diluted with deionized water to obtain 692 g. of a 25.0% aqueous solution of polymethacrylic acid.

The afore-mentioned dye-fixative compositions and related molecular weight data are summarized below in Table I.

TABLE I

DYE-FIXATIVE COMPOSITIONS AND DATA

| EX. | COMPOSITION | MOLE % INITIATOR | Mw | Mn |
|---|---|---|---|---|
| A | 89% MAA, 11% AMPS | 4.1 | 7,300 | 1,800 |
| B | 86% MAA, 14% AMPS | 4.2 | 17,900 | 2,900 |
| C | 100% MAA | 4.3 | 10,900 | 1,800 |
| D | 91% MAA, 9% SVS | 3.6 | 6,411 | 1,927 |
| E | 86% MAA, 14% AMPS (neutralized) | 4.2 | 17,900 | 2,900 |
| F | 86.2% MAA, 13.8% sodium styrene sulfonate (SSS) | 4.2 | 9,286 | 3,582 |
| G | 73.5% MAA, 12.7% BA, 13.8% SSS | 4.4 | 12,304 | 3,998 |
| H | 79% MAA, 10.8% BA, 10.2% SVS | 4.1 | 7,371 | 1,921 |
| I | 100% MAA | 4.3 | | |

MAA = Methacrylic Acid
AMPS = 2-Acrylamido-2-methyl-propanesulfonic acid
SVS = Sodium Vinyl Sulfonate
SSS = Sodium Styrene Sulfonate
BA = Butyl Acrylate In the following examples, the following two test methods were used to evaluate the effectiveness of the dye-fixative compositions:

I. Colorfastness To Water: AATCC Test Method 107-1991

Test Solution

Freshly boiled distilled water or deionized water from an ion-exchange apparatus.

Test Specimens

Apparel fabric made from Nylon 6 or 6,6, along with apparel fabric made from Lycra substrate, dyed with Rhodamine® B or other acid red dyestuff such as acid red 151, 266 or 337 and backed with a multifiber test fabric.

Procedure (1) The test specimen is immersed in the test solution at room temperature with occasional agitation to insure thorough wetting out for a period of 15 minutes.

(2) The test specimen is then removed from the test solution and is then passed through a wringer to remove excess liquor when the weight of the test specimen is more than 3 times its dry weight. Whenever possible, the wet weight should be 2.5–3.0 times the dry weight of the test specimen.

(3) The test specimen is then placed between glass or plastic plates and inserted into the specimen unit of an AATCC perspiration tester. The perspiration tester is adjusted to produce a pressure of 4.536 kg on the test specimen.

(4) The test specimen is then heated in an oven at 38°±1° C. for approximately 18 hours.

(5) The test specimen is then removed from the unit and hung in air at room temperature to complete the drying procedure.

Evaluation Method For Color Change

The test specimen was then rated on a scale from 5 to 1 for color, based on the Gray Scale for Color Change. The scale is from 5 to 1, with 5 representing negligible or no change in color, and I representing a significant change in color. The results for a number of varying test runs are found in Table III.

II. Colorfastness to Laundering, Home and Commercial

Accelerated Apparatus (1) Launder-O-meter, (2) Stainless steel cylinders, (3) Stainless steel balls, (4) AATCC Chromatic Transference Scale, (5) Gray Scale for Color Change.

Test Materials (a) Multifiber test fabric No. 1 containing bands of acetate, cotton, nylon, silk, viscose rayon and wool;

(b) Bleached cotton fabric;

(c) AATCC Standard Reference Detergent WOB (without optical brightener);

(d) AATCC Standard Reference Detergent 124 (with optical brightener);

(e) Water, either distilled or deionized;

(f) Sodium hypochlorite; and (g) Sodium carbonate.

Test Specimen

Nylon 6 or 6,6 and Lycra apparel fabric substrate dyed with Rhodamine® B or other acid red dyestuff such as acid red 151, 266 or 337 and backed with a multifiber test fabric.

Test Procedure

The test procedure was that of AATCC Test Method 61-1993.

Table II summarizes the conditions of the laundering tests.

TABLE II

| Test No. | Temp. (°C.) | Total Liquor Vol. | % Detergent/ Vol. | No. Steel Balls | Time |
|---|---|---|---|---|---|
| | | Test Conditions | | | |
| 1A | 40 | 200 ml | 0.5 | 10 | 45 min. |
| 2A | 49 | 150 ml | 0.2 | 50 | 45 min. |
| 3A | 71 | 50 ML | 0.2 | 100 | 45 min. |

Evaluation

The test specimens were evaluated using the Gray Scale for Color Change, as per above.

Test Specimens Preparation:

The dye-fixative composition prepared in Examples B, D, H and E, as well as comparative composition 1193D, were applied to nylon knit goods dyed with Rhodamine® B or with acid red 266 at an active substance concentration of about 6.0% by weight, and 4.0%/wt respectively, based on the weight of the substrate, in a bath at room temperature and a pH of about 4.5. The temperature of the bath containing the substrate was then raised to about 160° to about 180° F. The substrate was treated in the bath for about 20 to about 30 minutes, after which it was removed, rinsed and dried at a temperature of 80° F. Comparative composition 1193D represents the typical phenol-formaldehydesulfonic acid condensate polymer presently in common usage in the industry for acid dye fixation on Nylon. Comparative composition 1193D was an aqueous blend of a condensation product of 4,4' -dihydroxy- diphenyl sulfone, formaldehyde, and phenolsulfonic acid mixed with a condensation product of phenolsulfonic acid and formaldehyde wherein the blend was neutralized with sodium hydroxide.

Each sample was evaluated as per the above stated testing methods for colorfastness to water, the results being set forth in Table III; for wetfastness, the results being set forth in Table IV; and for washfastness, the results being set forth in Table V.

TABLE III

| Example | Rhodamine B ® | Acid Red 266 |
|---|---|---|
| | Colorfastness To Water Shade Change | |
| Control (Untreated) | 5 | 5 |
| B (6%) | 4.5 | 4.5 |
| D (6%) | 4.5 | 4.5 |
| H (6%) | 4.5 | 4.5 |
| E (6%) | 4.5 | 4.5 |
| 1193D (4%) | 3.0 | 4.0 |

TABLE IV

| Example | Rhodamine B ® | Acid Red 266 |
|---|---|---|
| | Wetfastness | |
| | Grey Scale Rating | |
| Control (Untreated) | 1.50 | 2.0 |
| B (6%) | 4.50 | 4.75 |
| D (6%) | 4.75 | 4.75 |
| H (6%) | 4.25 | 4.50 |

TABLE IV-continued

| Example | Rhodamine B ® | Acid Red 266 |
|---|---|---|
| | Wetfastness | |
| | Grey Scale Rating | |
| E (6%) | 4.00 | 4.75 |
| 1193D (4%) | 3.00 | 4.75 |

TABLE V

| Example | Rhodamine B ® | Acid Red 266 |
|---|---|---|
| | Washfastness | |
| | Test No. 2A Conditions | |
| Control (Untreated) | 5.0* | 4.75 |
| B (6%) | 5.0 | 4.75 |
| D (6%) | 5.0 | 4.75 |
| H (6%) | 5.0 | 4.75 |
| E (6%) | 5.0 | 4.75 |
| 1193D (4%) | 5.0 | 5.0 |

*Serious reduction in shade obtained even though dye did not transfer to test cloth.

Stain resistance evaluations were performed on 3 groups of undyed typical knit nylon apparel fabrics by applying thereto various dye-fixative compositions of this invention. The dye-fixative compositions were applied to the apparel fabrics by the exhaustion method from a water solution at about 160° F. for about 30 minutes. The concentration of dye-fixative composition was about 6%/wt active substance based on the weight of the fabrics, and the pH of the solution was about 4.5. After treatment, the fabrics were air-dried at room temperature for about 8 hours.

The test samples were 6 evaluated for their stain resistance properties according to AATCC Test Method 175-1993. In addition, the test samples were evaluated according to an older stain resistance scale (ca. 1989–1991). In this older stain resistance method a 6.5 g. test sample of dyed carpet is immersed in 40 g. of an aqueous solution containing 0.008 weight percent FD & C Red Dye No. 40 and 0.04 weight percent citric acid. The solution is allowed to remain on the test sample for eight hours at room temperature, i.e., about 22° C. The sample is rinsed under running tap water, dried and then evaluated for stain resistance using a graduated rating scale which ranges from 1 to 8, where a rating of 5 or higher is considered satisfactory.

Group 1 of the test fabrics represented a nylon knit style 314 obtained from Test Fabrics, Inc., Middlesex, N.J. Group 2 of the test fabrics represented a new sample of nylon knit obtained from Guilford Mills, Pine Grove, Pa. Group 3 of the test fabrics represented an old sample of nylon knit from Guilford Mills. The dye-fixative compositions applied to the test fabrics were example B, example D, example H, and example E shown in Table I. The stain resistance evaluation test results are shown in Table VI.

TABLE VI

| Fabric Group | Dye-Fixative Composition | AATCC Scale | Older Scale |
|---|---|---|---|
| 1 | Example B | 1 | 1 |
| 1 | Example D | 6 | 4 |
| 1 | Example H | 2 | 2 |
| 1 | Example E | 4 | 3 |
| control | untreated (control) | 2 | 2 |

TABLE VI-continued

| Fabric Group | Dye-Fixative Composition | AATCC Scale | Older Scale |
|---|---|---|---|
| 2 | Example B | 1 | 1 |
| 2 | Example D | 4 | 3 |
| 2 | Example H | 4 | 3 |
| 2 | Example E | 4 | 3 |
| control | untreated (control) | 2 | 2 |
| 3 | Example B | 1 | 1 |
| 3 | Example D | 4 | 3 |
| 3 | Example H | 4 | 3 |
| 3 | Example E | 4 | 3 |
| control | untreated (control) | 2 | 2 |

It can be seen from the foregoing results that although the dye-fixative compositions provide good colorfastness, i.e., wash fastness to knit and woven apparel fabric, they provide only partial resistance to staining and cannot be considered a satisfactory stainblocker for said fabrics.

What is claimed is:

1. A process for fixing a dye to a dyed fine-dimensional yarn fabric made from the group consisting of a polyamide-containing substrate, segmented polyester-polyurethane substrate, and combinations thereof, comprising contacting said fabric with an aqueous solution comprising a dye-fixative composition substantially free of phenol and formaldehyde residues, said dye-fixative composition comprising a copolymer of:

a) 1.0 to about 20 percent by weight of vinyl sulfonic acid residues;

b) 5 to 20 percent by weight of nonpolar or hydrophobic (meth)acrylic monomer residues; and c) 60 to about 94 percent by weight of hydrophilic ethylenically unsaturated carboxylic acid residues, the copolymers having a weight average molecular weight of from about 1,500 to about 15,000, said contacting step being for a time sufficient so that said dye-fixative composition is absorbed by said fabric.

2. The process of claim 1 wherein said copolymer comprises:

a) 1.5 to about 10 percent by weight of vinyl sulfonic acid residues;

b) 5 to about 20 percent by weight of residues of at least one composition selected from the group consisting of amides of (meth)acrylic acid with $C_4$ to $C_{10}$ amines, esters of (meth)acrylic acid with $C_2$ to $C_8$ alcohols, amides of $\alpha$-$C_2$ to $C_4$ alkyl acrylic acid with $C_4$ to $C_{10}$ amines and esters of $\alpha$-$C_2$ to $C_4$ alkyl acrylic acid with $C_2$ to $C_8$ alcohols; and c) about 70 to about 93.5 percent by weight of residues of at least one acid selected from the group consisting of (meth)acrylic acid, maleic anhydride, itaconic acid, furmaric acid and $\alpha$-$C_2$ to $C_4$ alkyl acrylic acids.

3. The process of claim 1 wherein said copolymer comprises:

a) 1.5 to 10 percent by weight of vinyl sulfonic acid residues;

b) 5 to about 20 percent by weight of residues of at least one ester of (meth)acrylic acid with a $C_3$ to $C_6$ aliphatic alcohol; and c) 70 to about 93.5 percent by weight of (meth)acrylic acid.

4. The process of claim 1 wherein said copolymer comprises:

a) 1.5 to 6 percent by weight of vinyl sulfonic acid residues;

b) 5 to 20 percent by weight of at least one ester of acrylic acid with a $C_3$ to $C_6$ aliphatic alcohol; and c) about 74 to about 93.5 percent by weight of methacrylic acid residues wherein the copolymer has a weight average molecular weight of from about 3,000 to about 9,000.

5. The process of claim 1 wherein said copolymer comprises:

a) 1.5 to less than 5 percent by weight of vinyl sulfonic acid residues;

b) 5 to 15 percent by weight of butyl acrylate residues; and c) 80 to 93.5 percent by weight of methacrylic acid residues.

6. The process of claim 1 wherein said copolymer comprises:

a) about 2 to about 4 percent by weight of vinyl sulfonic acid residues;

b) about 8 to about 14 percent by weight of butyl acrylate residues; and c) about 82 to about 90 percent by weight of methacrylic acid residues.

* * * * *